US005971331A

United States Patent [19]

Getsay

[11] Patent Number: 5,971,331

[45] Date of Patent: Oct. 26, 1999

[54] WRIST SUPPORT FOR USE WITH ELECTRONIC COMPUTING DEVICES

[76] Inventor: James G. Getsay, 125 Ziegler Dr., Garmony, Pa. 16037

[21] Appl. No.: 08/896,526

[22] Filed: Jun. 19, 1997

[51] Int. Cl.[6] ..... B43L 15/00

[52] U.S. Cl. ..... 248/118; 248/118.1; 248/918; 400/715

[58] Field of Search ..... 248/118, 118.1, 248/118.3, 118.5, 918, 346.07, 349.1; 400/715; 193/35 R

[56] References Cited

U.S. PATENT DOCUMENTS

| | | | |
|---|---|---|---|
| 607,675 | 7/1898 | Barr | 248/118.1 |
| 653,942 | 7/1900 | Willis et al. | 193/35 R X |
| 709,114 | 9/1902 | Rockwell . | |
| 842,155 | 1/1907 | Mathews et al. | 193/35 R |
| 1,308,355 | 7/1919 | Hollins . | |
| 1,628,030 | 5/1927 | Catlett | 248/118 X |
| 3,792,500 | 2/1974 | Swara et al. | 193/35 R X |
| 4,483,634 | 11/1984 | Frey et al. | 400/715 X |
| 5,050,826 | 9/1991 | Johnston | 248/118.3 |
| 5,079,789 | 1/1992 | Jandrakovic | 248/349.1 X |
| 5,120,010 | 6/1992 | Magee | 248/918 X |
| 5,265,835 | 11/1993 | Nash . | |
| 5,288,042 | 2/1994 | Grimm | 248/918 X |
| 5,342,005 | 8/1994 | Szmanda et al. | 248/918 X |
| 5,386,957 | 2/1995 | Miller . | |
| 5,398,896 | 3/1995 | Terbrack | 248/118 X |
| 5,405,109 | 4/1995 | Nordnes | 248/918 X |
| 5,464,292 | 11/1995 | Grant | 248/118.1 X |
| 5,467,950 | 11/1995 | Dumitru . | |
| 5,472,161 | 12/1995 | Krukovsky . | |
| 5,478,034 | 12/1995 | Cunningham et al. . | |

*Primary Examiner*—Derek J. Berger
*Attorney, Agent, or Firm*—Aileen Champion Addessi

[57] ABSTRACT

A wrist support for use with electronic computing devices includes a plurality of rollers rotatably attached to roller supports, which are attached to a base. The rollers are positioned arcuately within the roller supports having a center roller positioned at a slightly higher elevation as compared to adjacent rollers. The rollers have protuberances at each end for engagement with holes in the roller supports for enabling the rollers to rotate about an axis. The rollers may also be inclined at a first angle extending from an inner roller support toward an end roller support and at a second angle extending from the inner roller support toward the other end roller support. Pads are attached to the base for enabling the base to flex and provide a cushion between the base and a support surface. Spacers are attached to the base so that the rollers contact the spacers instead of contacting the base. The wrist support may additionally include a pivot attached to the base and to a support for enabling the base and rollers to pivot about the support for use with a computer mouse. Alternatively, the wrist support may include an expandable member attached to a two piece base for enabling a person to adjust the space between adjacent sets of rollers.

17 Claims, 6 Drawing Sheets

WRIST SUPPORT FOR USE WITH ELECTRONIC COMPUTING DEVICES

BACKGROUND OF THE INVENTION

The invention relates to wrist supports and, more particularly, to a wrist support for use with electronic computing devices.

Long operation and repetitious muscle movement of a person's hands may cause or contribute to tiredness, strain, carpal tunnel syndrome or other serious health problems when the person's wrists are not properly positioned. Various supports have been used to alleviate or avoid risk of health problems.

One such device is disclosed in U.S. Pat. No. 5,467,950 issued to Dumitru and entitled "Multipurpose Forearm/Wrist Support for Users of Data Input Devices". The support includes a plurality of beads rotatable about a fixed rod, which is attached to a base. However, the beads do not provide a large contact area for a person's wrist due to the space or non-contact points between each of the beads.

U.S. Pat. No. 5,478,034 to Cunningham et al. and entitled "Keyboard Comfort Aid" discloses a wrist support device including two rollers rotatable about a fixed rod and attached to a base. However, the rollers are not positioned angularly or arcuately for improving the comfort and health benefits of a wrist support.

Therefore, what is needed is an apparatus for supporting a wrist or hand of a person during use of a computer keyboard and mouse which utilizes arcuately and angularly positioned rollers for providing maximum contact points and comfort for support of the user's wrist and/or hand.

SUMMARY OF THE INVENTION

A wrist support includes a base having a first end and a second end. At least two roller supports are positioned in spaced apart relation and attached to the base. The roller supports have a first edge and a second edge. A plurality of rollers are rotatably attached to the roller supports. At least one of the plurality of rollers is spaced a greater distance vertically upwardly from the base as compared to the position of the other of the rollers. Adjacent rollers are vertically upwardly spaced from the base a descending distance from the roller spaced a greater distance vertically upwardly from the base toward each of the first and second edges for arcuately positioning the rollers within the roller supports.

The wrist support further includes the roller supports having a plurality of holes disposed at least partially therethrough and positioned extending from a first edge to a second edge of the roller support. The rollers each have a first end and a second end and a protuberance extending from each of the first and second ends. The protuberance is engagable within the holes of the roller supports for rotatably attaching the rollers to the roller supports.

The wrist support may further include a plurality of pads attached to the base for resting on a support surface, a spacer attached to the base, the base being formed of a flexible material, a pivot attached to the base for pivotal movement of the base, and an expandable member for adjusting the space between the sets of rollers.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for supporting a wrist and hand of a person using a computer keyboard or mouse.

Figure 1:
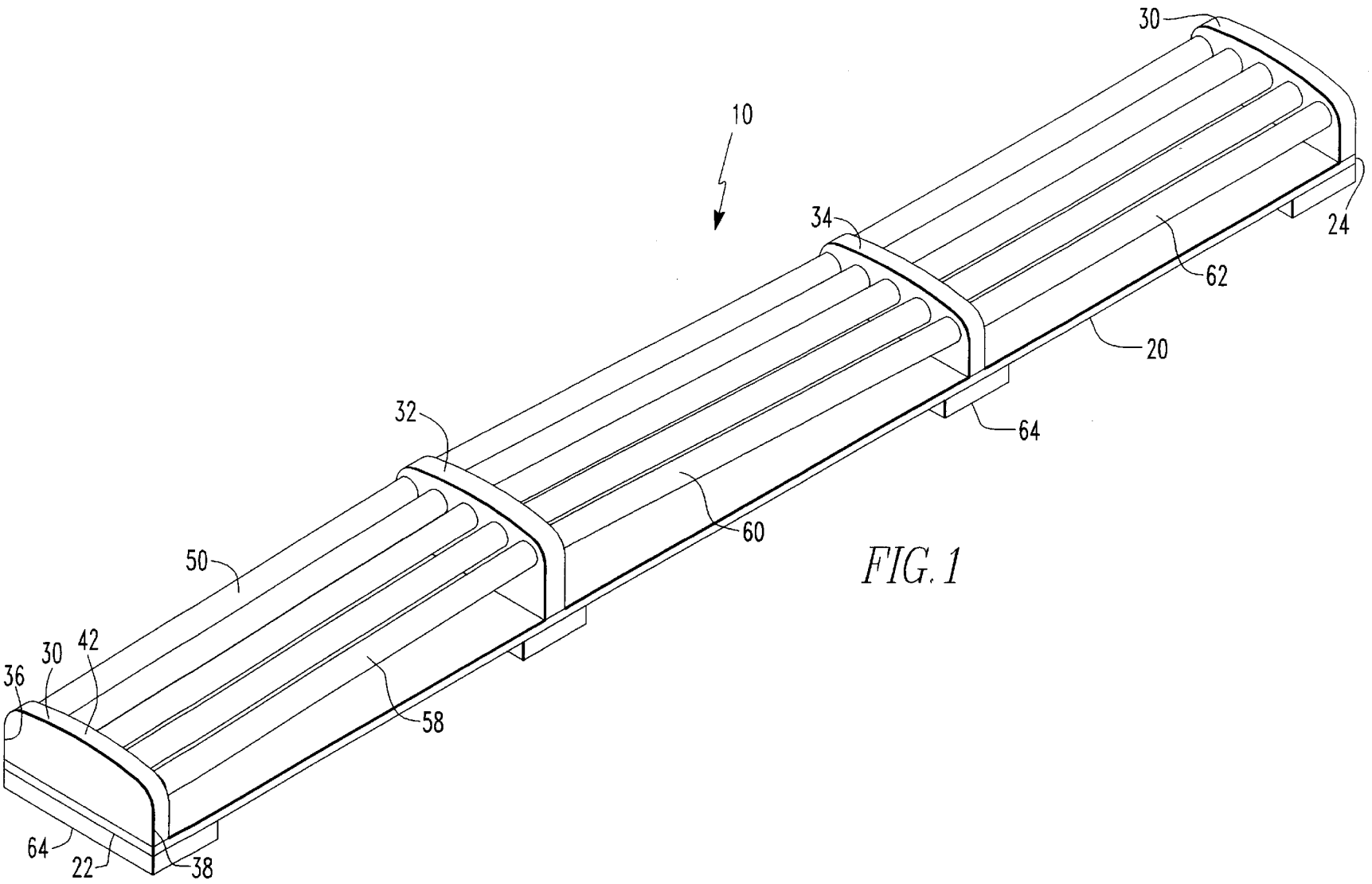
FIG. 1 is a schematic illustration of a wrist support for use with electronic computing devices.
Figure 2:
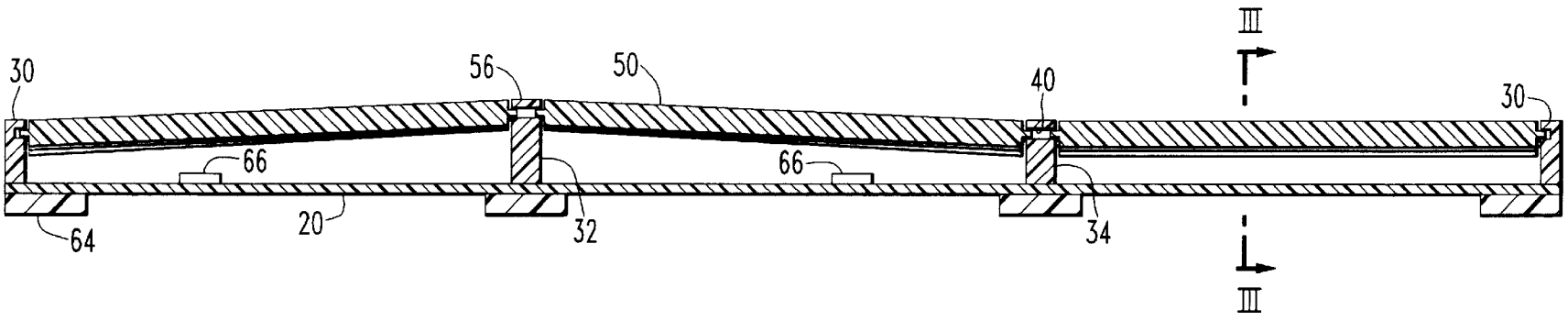
FIG. 2 is a side sectional view of the wrist support.
Figure 3:
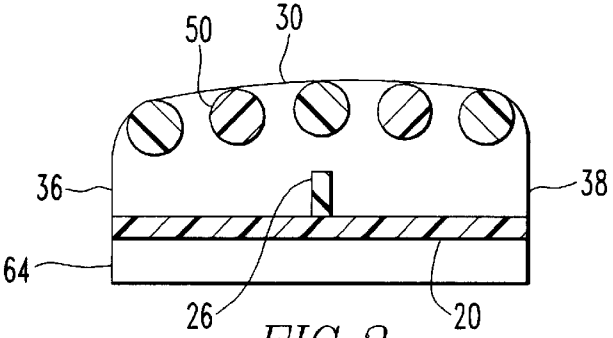
FIG. 3 is a sectional view taken along line 3—3 of FIG. 1 showing arcuately orientated rollers of the wrist support.

Referring to FIGS. 1–3, a wrist support 10 includes a base 20. The base 20 has a first end 22 and a second end 24 A brace 26 may be attached to or integrally formed with the base 20 and extends the length of the base 20 for providing support to the base 20. The base 20 is formed of a flexible material for providing comfort to a person using the wrist support 10.

A plurality of roller supports are attached to the base 20 and extend vertically upward. An end roller support 30 is attached to the first end 22 and to the second end 24, and at least one inner roller support is attached therebetween. The inner roller support may include a first inner roller support 32 positioned between one of the end roller supports 30 and a second roller support 34. The second roller support 34 is positioned between the other of end roller supports 30 and the first inner roller support 32. Each of the roller supports 30, 32 and 34 has a first edge 36 and a second edge 38.

Each of the roller supports 30, 32 and 34 has a plurality of holes 40 at least partially therethrough. The holes 40 are arcuately spaced between the first edge 36 and the second edge 38. The hole 40 positioned at a center of the roller supports 30, 32 and 34 is spaced vertically upwardly a greater distance from the base 20 as compared to the distance the other holes 40 are spaced. Preferably the hole 40 positioned at the first edge 36 (i.e. the side of the wrist support 10 positioned farthest from the person using the wrist support) is spaced vertically upwardly from the base 20 a distance having a lowest elevation as compared to the other holes 40. Additional holes 40 positioned between the ends 36 and 38 are spaced at various distances from the base 20 for forming an arc extending from the first edge 36 to the second edge 38 and having the highest point of the arc positioned at substantially the center 42 and the lowest point of the arc positioned at the end 36 of the roller supports 30, 32 and 34. Alternatively, the holes 40 positioned at the first edge 36 and at the second edge 38 may be spaced at a substantially equal distance from the base 20.

A plurality of rollers 50 are rotatably supported by the roller supports 30,32 and 34. The roller 50 is an elongated cylindrical member having a first end 52 and a second end 54. A protuberance 56 extends from each of the first and second ends 52 and 54 for engagement with the holes 40 of the roller supports 30 and 32. The roller 50 and the protuberances 56 rotate as a single unit within the holes 40 of the roller supports 30, 32 and 34. By slightly suspending or by positioning the rollers 50 vertically upwardly spaced from the base 20, the friction exerted on the roller 50 is reduced.

Each of the rollers 50 are positioned at a slightly higher or lower elevation than adjacent rollers 50 for arcuately positioning the rollers 50 within the roller supports 30,32 and 34. As an alternative to using five rollers and having the center roller 50 spaced a greater distance from the base 20 as compared to the other rollers 50, referring to FIG. 6, two rollers 50 are positioned at the center of the roller supports and are spaced at a substantially equal distance from the base 20.

Preferably, the wrist support 10 includes three sets of five rollers 50. A first set 58 of five rollers 50 is positioned between and supported by the roller support 30 positioned at the first end 22 and the roller support 32. A second set 60 of five rollers 50 is positioned between and supported by the roller support 32 and the roller support 34. A third set 62 of five rollers 50 is positioned between and supported by the roller support 34 and the roller support 30 positioned at the second end 24.

The holes 40 of the roller supports 30 and 34 are substantially equally spaced a distance from the base 20. The holes 40 of the roller support 32 are spaced a greater distance from the base 20 as compared to the holes 40 of the roller supports 30 and 34 for positioning the rollers 50 supported by the roller support 32 at an angle. The first set 58 of rollers 50 extends descendingly from the roller support 32 to the roller support 30 for providing a first inclined support surface for one of a person's wrist or hand during use of a computer keyboard. The second set 60of rollers 50 extends descendingly from the roller support 32 to the roller support 34 for providing a second inclined support surface for the other of the person's wrist or hand during use of the computer keyboard. The third set 62 of rollers 50 extends substantially horizontally and parallel to a support surface, such as a desk top, for providing an alternative support surface for the person's wrist or hand, such as for use of a numerical keypad of the computer keyboard. As an alternative to the rollers 50 being rotatable about a sloped axis along an incline, all of the rollers 50 may be rotatable about a generally horizontally oriented axis.

The wrist support 10 includes a plurality of pads 64 attached to the base 20 for providing a cushion between the base 20 and the support surface or desk top. The pads 64 may be formed of a flexible, shock absorbent, and non-skid material, such as foam or other suitable material. Preferably, the pads 64 are positioned aligned with each of the roller supports 30, 32 and 34.

A spacer 66 is attached to the base 20 between the base 20 and the rollers 50 for providing a contact point for at least one of the rollers 50. In the event a person's hand or wrist flexes the rollers 50 or base 20, the roller 50 will contact the spacer 66 instead of contacting the base 20. Preferably, one spacer 66 is positioned between the roller support 32 and the roller support 30, and another spacer 66 is positioned between the roller support 32 and the roller support 34.

For the various embodiments of this invention, the same reference characters will be used to designate like parts. In addition, like functions and like interactions of the parts among the various embodiments of this invention will not be repeated for each embodiment.

Figure 4:
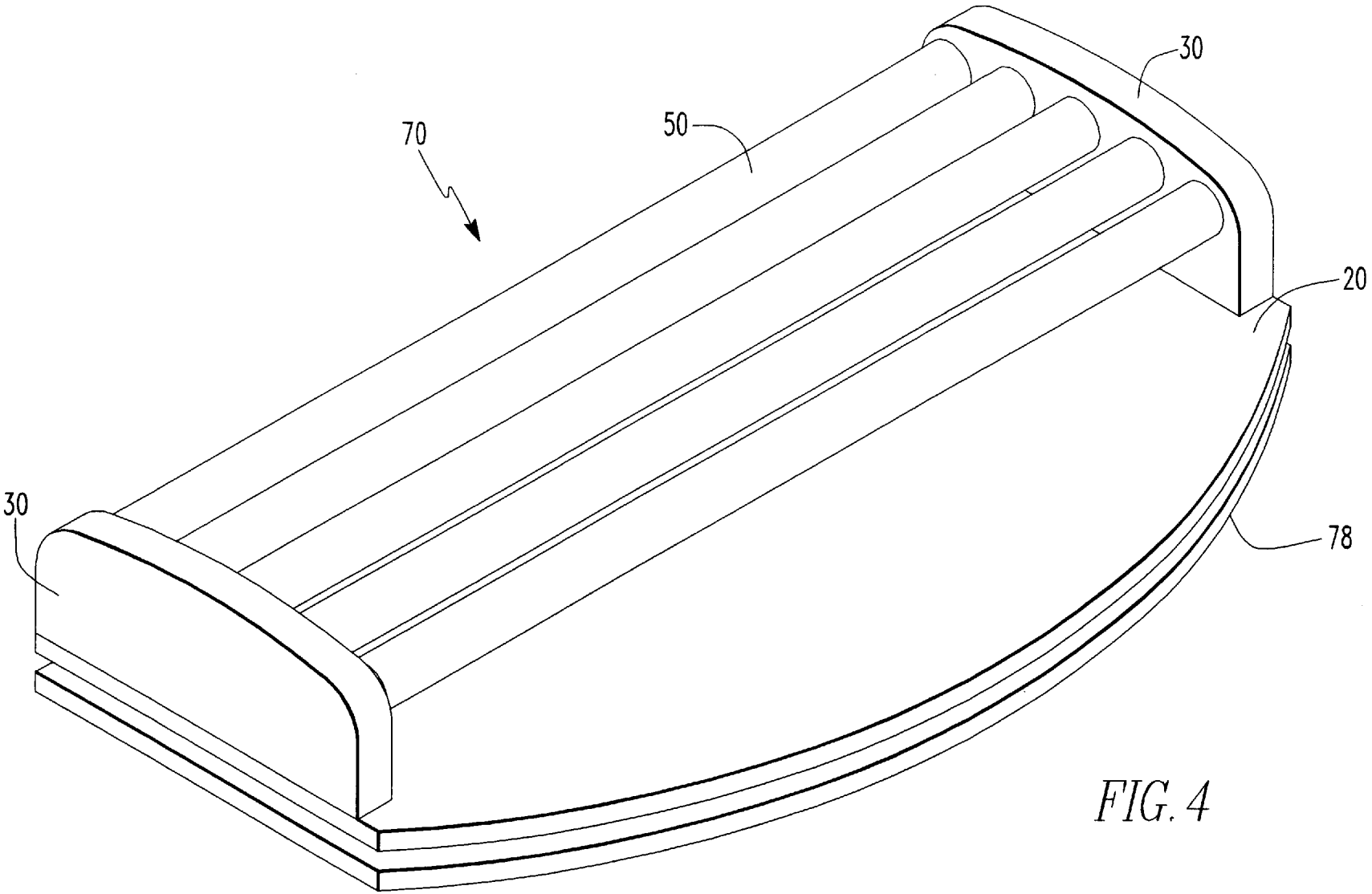
FIG. 4 is a schematic illustration of an alternative embodiment of the wrist support.
Figure 5:
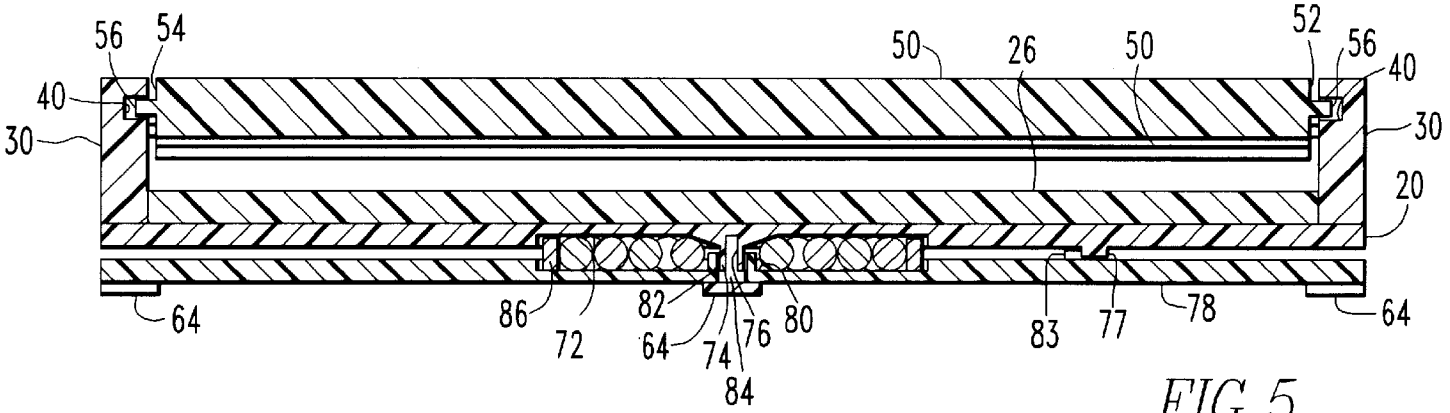
FIG. 5 is a side sectional view of the wrist support of FIG. 4.
Figure 6:
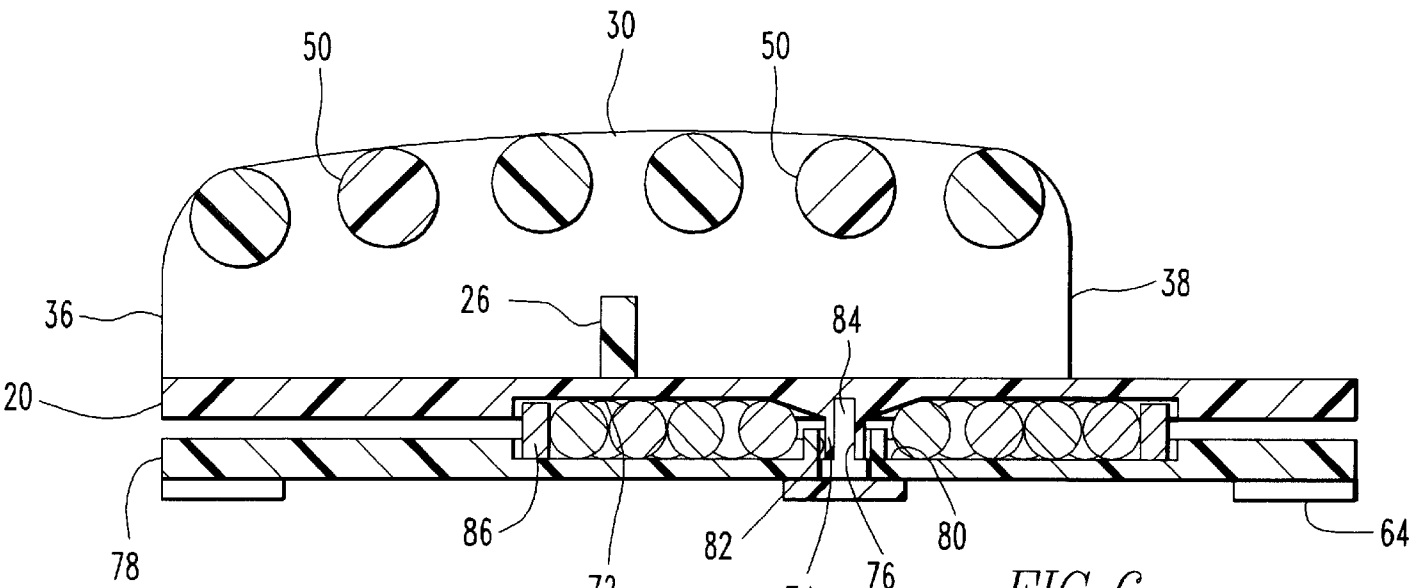
FIG. 6 is a sectional view of another alternative embodiment of the wrist support showing positioning of six rollers within roller supports.

Referring to FIGS. 4–6 and using the same reference characters to define like parts, an alternative embodiment of the wrist support 10 as illustrated in FIGS. 1–3 may be a wrist support 70 having like parts as the wrist support 10 and the base 20 additionally having a pivot for enabling the rollers 50 to swivel about a fixed axis. The base 20 includes a recess 72, a protuberance 74 with a bore 76, and a movable contact member 77.

A support 78 is pivotally attached to the base 20 and has a recess 80, a bore 82, and a pair of stop members 83. The bore 82 is sized and positioned so that the protuberance 74 of the base 20 fits within the bore 82 of the support 78 and is rotatable therein.

A pin, such is a screw 84, bolt or other suitable means, is disposed through the bore 82 of the support 78 and through the bore 76 of the base 20 for pivotally attaching together the base 20 and the support 78. A bearing, such as ball bearing 86 or other suitable pivot means, may be positioned within the recess 72 of the base 20 and the recess of the support 78 for improving pivotal movement of the base 20 with respect to the stationary support 78.

The pads 64 are attached to the support 78 and rest on a support surface, such as a desk. The movable contact member 77, which is attached to or integrally formed with the base 20, contacts the stop members 83, which are attached to or integrally formed with the support 78, for restricting pivotal movement of the rollers 50.

Figure 7:
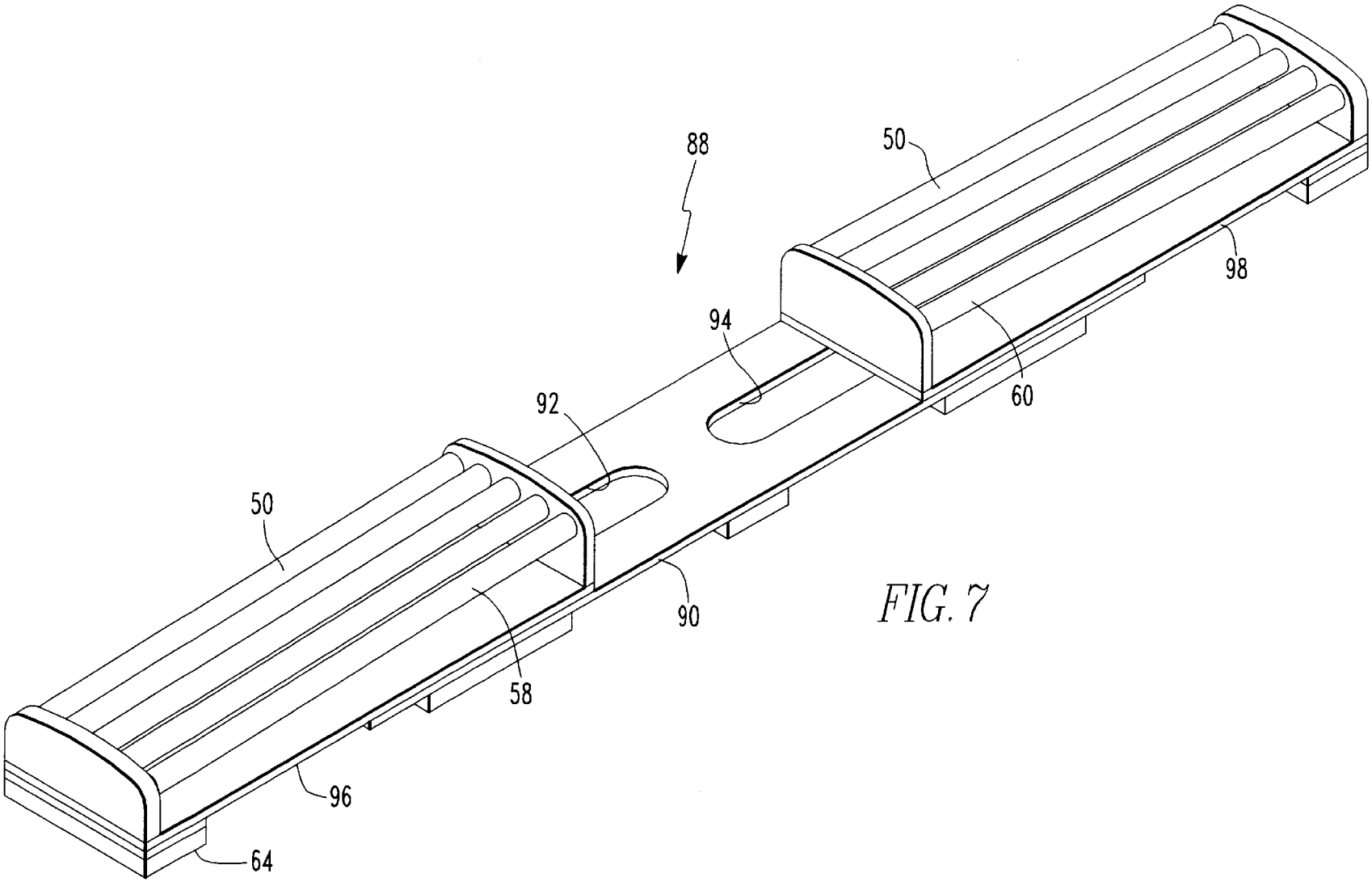
FIG. 7 is a schematic illustration of yet another alternative embodiment of the wrist support.
Figure 8:
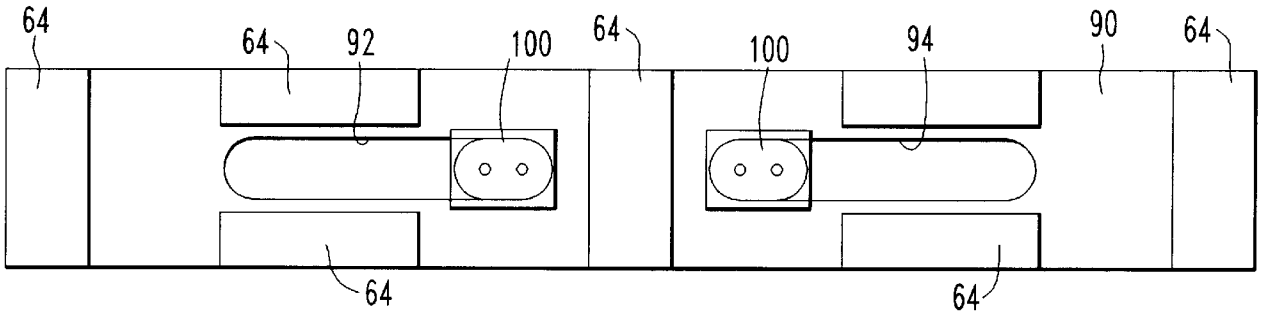
FIG. 8 is a bottom view of the wrist support of FIG. 7 in a closed position.
Figure 9:
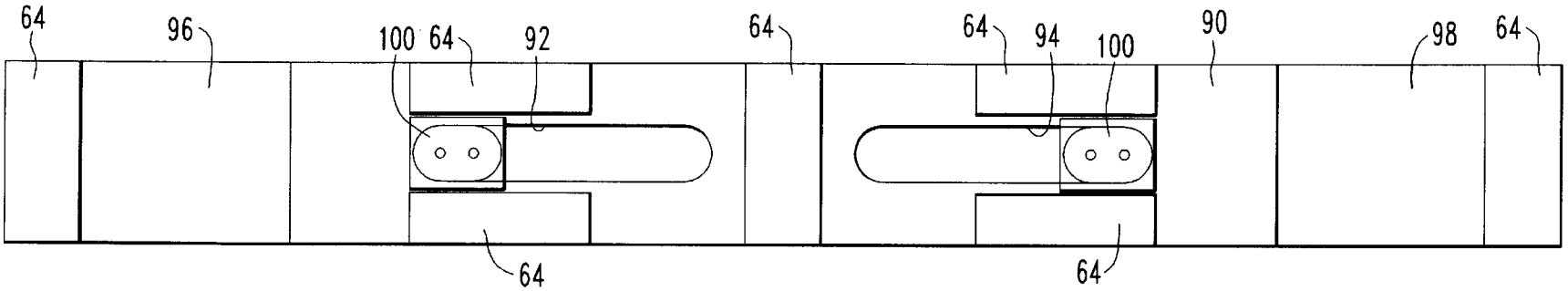
FIG. 9 is a bottom view of the wrist support of FIG. 7 in an expanded or open position.

Referring to FIGS. 7–9 and using the same reference characters to define like parts, an alternative embodiment of the wrist support 10 as illustrated in FIGS. 1–3 may be a wrist support 88 having like parts as the wrist support 10 and additionally having an expandable member 90 attached to the base 20 for enabling the first and second set 58 and 60 of rollers 50 to be separated from one another. By enabling the space between the rollers 50 to be adjusted, a person can expand the wrist support 88 to suit his or her comfort needs.

The expandable member 90 includes a mating connection, such as a first slot 92 and a second slot 94. The base 20 is two pieces including a first base member 96 and a second base member 98. Each of the first and second base members 96 and 98 has a mating connection 100 engagable with the slots 92 and 94 and slidable therein.

The pads 64 are attached to the base 20 and to the expandable member 90. The roller support 32 is two pieces for providing a side support for each set of rollers 50.

The components of the wrist support, such as the base 20, the roller supports 30, 32, and 34, the rollers 50, the spacers 66, and the expandable member 90, may be formed of any suitable material, such as plastic, other lightweight materials, wood, metal, or the like. The various components of the wrist support 10, 70 or 88 may be attached, such as adhesively, by mechanical means, or may be integrally formed together. As one example, the base 20 and support 30 may be integrally formed together or may be two separate pieces adhesively secured together.

In operation, a person positions the wrist support 10 or 88 adjacent a computer keyboard or the wrist support 70 adjacent a computer mouse. Each of a person's wrists and/or hands rests on one set of the rollers 50. During use of the computer devices, the person's hand and wrist may roll forward and backward while resting on the rollers 50. The person's hand and wrist may also slide easily laterally along the rollers 50. The pivotal movement of the base 20 of the wrist support 70 enhances a person's control of the computer mouse.

An advantage of the use of a plurality of rollers 50 is that it provides the person a large contact surface for resting his or her hands or wrists. Providing a maximum amount of contact points with a minimum amount of space, or non-contact points, therebetween improves the comfort and health benefits derived from use of the wrist support.

Arcuately and angularly positioning the rollers 50 within the roller supports 30,32 and 34 improves the comfort and health benefits for a person using the wrist support.

An advantage of the use of rollers 50 which rotate, as compared to rollers which rotate about a fixed rod, is that the overall cost of the wrist support is reduced.

Thus there has been shown and described a novel wrist support which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A wrist support, comprising:

a base having a first end and a second end;

at least two roller supports positioned in spaced apart relation and attached to said base, said roller supports having a first edge and a second edge, said at least two roller supports including an end roller support positioned at each of said first and second ends of said base, a first roller support and a second roller support, said first roller support positioned between one of said end roller supports and said second roller support and said second roller support positioned between the other of said end roller supports and said first roller support;

a first set of a plurality of rollers rotatable attached between one of said end roller supports and said first roller support and extending at an angle relative to said base from said first roller support descending toward said end roller support for providing a first inclined support surface;

a second set of a plurality of rollers rotatably attached between said first and second roller supports and extending at an angle relative to said base from said first roller support descending toward said second roller support for providing a second inclined support surface;

a third set of a plurality of rollers rotatable attached between said second roller support and the other of said end roller supports and extending substantially parallel with said base for providing an alternative support surface;

each of said first, second and third sets of said plurality of rollers including a first elongated cylindrical roller positioned at said first edge of said roller supports;

each of said first, second and third sets of said plurality of rollers including a second elongated cylindrical roller positioned at said second edge of said roller support; and each of said first, second and third sets of said plurality of rollers including at least one third elongated cylindrical roller positioned between said first and second edges and at a greater distance vertically upwardly from said base as compared to said first and second elongated cylindrical rollers.

2. The wrist support according to claim 1, wherein said first elongated cylindrical roller positioned at said first edge of said roller support is spaced a smaller distance vertically upwardly from said base as compared to said second and said third elongated cylindrical rollers for arcuately positioning said rollers within said roller supports.

3. The wrist support according to claim 1, further comprising:

said roller supports having a plurality of holes disposed at least partially therethrough; and said first, second and third rollers having a first end and a second end and a protuberance extending from each of said first and second ends, one of said first, second and third rollers positioned between two of said roller supports having said protuberance engagable within said holes of said roller supports for rotatably attaching said rollers to said roller supports.

4. The wrist support according to claim 1, further comprising a plurality of pads attached to said base.

5. The wrist support according to claim 1, further comprising at least one spacer attached to said base.

6. The wrist support according to claim 1, wherein said base is formed of a flexible material.

7. The wrist support according to claim 1, further comprising:

said base including a first base member and a second base member, each of said first and second base members having a mating connection; and an expandable member having at least one mating connection engagable with said mating connections of said first and second base members for slidably connecting together said first and second base members and said expandable member.

8. A wrist support, comprising:

a base having a first end and a second end;

a pivot attached to said base for pivotal movement of said base;

at least two roller supports positioned in spaced apart relation and attached to said base, said roller supports having a first edge and a second edge;

a first elongated cylindrical roller rotatably attached to said roller supports and positioned at said first edge of said roller supports;

a second elongated cylindrical roller rotatably attached to said roller supports and positioned at said second edge of said roller supports; and at least one third elongated cylindrical roller rotatably attached to said roller supports and positioned between said first and second edges and at a greater distance vertically upwardly from said base as compared to said first and second rollers.

9. The wrist support according to claim 8, wherein said pivot further comprises:

a support having a recess and a bore for providing a stationary member;

said base having a recess and a bore;

a pin disposed within said bore of said support and within said bore of said base for providing pivotal movement of said base with respect to said support; and a bearing positioned within said recesses of said base and said support for improving pivotal movement of said base.

10. The wrist support according to claim 8, further comprising a plurality of pads attached to said base.

11. The wrist support according to claim 8, further comprising a plurality of holes disposed at least partially through said roller supports and positioned extending arcuately from said first edge to said second edge of said roller supports.

12. The wrist support according to claim 8, wherein said base is formed of a flexible material.

13. The wrist support according to claim 8, further comprising a support pivotally attached to said base for providing a stationary member and enabling said base to pivot with respect to said support.

14. The wrist support according to claim 13, further comprising:

said base having a contact member; and said support having a pair of stop members positioned so that said contact member contacts said stop members during pivotal movement of said base for restricting pivotal movement of said base with respect to said support.

15. A wrist support, comprising:

a base having a first end and a second end;

a roller support positioned at and attached to each of said first and second ends of said base for providing end roller supports, said end roller supports having a first edge and a second edge, and having a plurality of holes disposed at least partially therethrough and positioned extending from said first edge to said second edge of said end roller support;

at least one roller support positioned between said end roller supports and attached to said base for providing an inner roller support, said inner roller support having a first edge and a second edge, and having a plurality of holes disposed at least partially therethrough and positioned extending from said first edge to said second edge of said inner roller support, said holes of said inner roller support vertically upwardly spaced from said base a greater distance than said holes of said end roller supports;

a first set of a plurality of elongated cylindrical rollers rotatably attached to one of said end roller supports and to said inner roller support for providing a first inclined support surface for a hand or wrist of a person; and a second set of a plurality of elongated cylindrical rollers rotatably attached to the other of said end roller supports and to said inner roller support for providing a second inclined support surface for another hand or wrist of a person.

16. The wrist support according to claim 15, further comprising:

said end roller supports including a first end roller support and a second end roller support;

said at least one roller support includes said inner roller support being a first inner roller support and said at least one roller support further including a second inner roller support, having said first inner roller support positioned between said first end roller support and said second inner roller support and having said second inner roller support positioned between said first inner roller support and said second end roller support;

said second inner roller support having a plurality of holes positioned in spaced apart relation vertically upwardly from said base and at a substantially equal distance from said base as said holes of said second end roller support;

said first set of said rollers positioned between and within said holes of said first inner roller support and said first end roller support and inclined at a first angle, said first angle descending from said first inner roller support toward said first end roller support;

said second set of said rollers positioned between and within said holes of said first inner roller support and said second inner roller support and inclined at a second angle, said second angle descending from said first inner roller support toward said second inner roller support; and a third set of a plurality of rollers positioned between and within said holes of said second inner roller support and said second end roller support for providing an alternate support surface a person's hand or wrist.

17. The wrist support according to claim 15, further comprising:

said base including a first base member and a second base member, each of said first and second base members having a mating connection; and an expandable member having a first slot sized and adapted to engage said mating connection of said first base member and having a second slot sized and adapted to engage said mating connection of said second base member for slidably connecting together said first and second base members and said expandable member.

* * * * *